US008840327B2

(12) United States Patent
Okada

(10) Patent No.: US 8,840,327 B2
(45) Date of Patent: Sep. 23, 2014

(54) PRINTING APPARATUS, PRINTING CONTROL METHOD, AND PROGRAM

(75) Inventor: Hideyuki Okada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 408 days.

(21) Appl. No.: 13/228,340

(22) Filed: Sep. 8, 2011

(65) Prior Publication Data

US 2012/0063832 A1 Mar. 15, 2012

(30) Foreign Application Priority Data

Sep. 13, 2010 (JP) ..... 2010-204358

(51) Int. Cl.
*B41J 11/44* (2006.01)
*G03G 15/00* (2006.01)
*B41J 13/00* (2006.01)

(52) U.S. Cl.
CPC ..... *B41J 13/009* (2013.01); *G03G 15/655* (2013.01); *G03G 2215/00476* (2013.01); *G03G 2215/00869* (2013.01); *G03G 2215/00894* (2013.01)
USPC ..... 400/76; 399/405; 271/279

(58) Field of Classification Search
CPC ..... G03G 15/5029; G03G 2215/00475; G03G 2215/00443; G03G 2215/00751; G03G 2215/00729; G03G 2215/00738; G03G 2215/00759; G03G 2215/00886; G03G 2215/00894; B41M 5/10; B41J 7/00
USPC ..... 399/405; 271/279; 400/38, 190, 497, 400/503, 513, 516
See application file for complete search history.

(56) References Cited

U.S. PATENT DOCUMENTS

| | | | | |
|---|---|---|---|---|
| 6,793,218 | B2 * | 9/2004 | Pickett | 271/279 |
| 8,235,387 | B2 * | 8/2012 | Tanaka | 271/288 |
| 8,379,237 | B2 * | 2/2013 | Tominaga | 358/1.13 |
| 2005/0281966 | A1 * | 12/2005 | Chee | 428/32.69 |

FOREIGN PATENT DOCUMENTS

JP 2008-201033 A 9/2008

* cited by examiner

*Primary Examiner* — Matthew G Marini
(74) *Attorney, Agent, or Firm* — Canon U.S.A., Inc., IP Division

(57) ABSTRACT

Processing time for switching discharge destinations can be reduced by providing a first acquisition unit configured to acquire a first parameter indicating a number of middle sheets included in one set of carbonless copy paper set in a sheet feed tray, a second acquisition unit configured to acquire a second parameter indicating a number of middle sheets included in one target product, and a control unit configured to, if the second parameter is greater than the first parameter, print on a top sheet and a middle sheet needed for printing a print job, discharge a bottom sheet and a top sheet and a middle sheet included in a next set that are not needed for printing the print job to a discharge destination different from a discharge destination of the target product, and to print on a middle sheet and a bottom sheet needed for printing the print job.

6 Claims, 11 Drawing Sheets

PRINTING APPARATUS, PRINTING CONTROL METHOD, AND PROGRAM

BACKGROUND OF THE INVENTION

1. Field of the Invention

The present invention relates a printing apparatus, a print control method, and a program.

2. Description of the Related Art

Pressure-sensitive paper, which is specially treated paper, is used to make copies of actual autograph contents on a plurality of sheets of the paper using writing pressure. Conventional pressure-sensitive paper has been used as a mechanism that carbon paper on which special ink using carbon for copying is applied is placed between sheets, and writing pressure is applied on the sheets to deposit the ink of the carbon paper on the sheets. However, carbonless copy paper that can make copies without using the carbon paper has been developed and widely used.

The carbonless copy paper typically consists of three types of sheets called a top sheet, a middle sheet, and a bottom sheet, which are typically arranged in an order of the top sheet on top, the middle sheet in the middle, and the bottom sheet on the bottom. Copying is performed using a chemical reaction of a color former and a color developer instead of carbon. The top sheet is coated only on its back side with a micro-encapsulated color former. The middle sheet is coated on its front side with a color developer and on its back side with the color former, respectively. The bottom sheet is coated only on its front side with the color developer.

When writing pressure is applied, such as with a ballpoint pen, on the top sheet where the sheets are sorted in the order of the top, middle, and bottom sheets, the microcapsules coated on the back sides of the top sheet and the middle sheet are broken. The color former causes chemical reactions with the color developer coated on the front sides of the middle sheet and the bottom sheet respectively. In this way, color appears. Since the carbonless copy paper has such a mechanism, the order of the sheets is important. For example, if the bottom sheet is placed on the top sheet and characters are written from the top to the bottom sheet, the characters are not copied on the bottom sheet. Thus, the sheets are designed to prevent incorrect use, for example, by coloring the top sheet, the middle sheet, and the bottom sheet different colors respectively.

Some carbonless copy paper are sold separately as top sheets, middle sheets, and bottom sheets respectively, and some carbonless copy paper is sold as one set of the three types of sheets sorted in the correct order. In the latter case, various sets can be provided, for example, the number of the middle sheets can range from zero sheets to multiple sheets. However, since the mechanism uses writing pressure or printing pressure, if the number of the middle sheets is too large, the pressure is not sufficiently transferred, and the copy is not properly made. Therefore, the number of the middle sheets is usually up to three or four (five or six in all).

An example of printing using the carbonless copy paper will now be described. In this example, a set containing two middle sheets is set on a sheet feed tray of an image forming apparatus. In this state, if a job for a product that includes one middle sheet is input, first, one top sheet and one middle sheet are supplied from the sheet feed tray in the order, and printing is performed. Then, the image forming apparatus tries to print on the bottom sheet. However, since one unnecessary middle sheet remains on the sheet feed tray, the unnecessary middle sheet is discharged to the outside of the image forming apparatus. Then, the bottom sheet is supplied and printing is performed.

If a job for a product that includes three middle sheets is input, first, one top sheet and two middle sheets are supplied from the sheet feed tray in that order, and printing is performed. Then, since one more middle sheet is necessary, the apparatus tries to perform printing on a middle sheet. However, an unnecessary bottom sheet and the top sheet of a second set still remain on the sheet feed tray. These unnecessary sheets are discharged to the outside of the image forming apparatus, and printing is performed on the middle sheet of the second set. Further, the image forming apparatus tries to print on the bottom sheet. However, since one unnecessary middle sheet remains on the sheet feed tray, the unnecessary middle sheet is discharged to the outside of the image forming apparatus. Then, the bottom sheet is supplied and printing is performed.

The method for performing printing while unnecessary sheets are discharged to the outside of the image forming apparatus includes, for example, a method for printing on an index sheet while discharging an unnecessary index sheet to the outside of the image forming apparatus (see, Japanese Patent Application Laid-Open No. 2008-201033). The index sheet is usually sold as one set of a plurality of sheets sorted in a predetermined order. However, in generating a product using the index sheets, not all of the one set is always used. By automatically discharging the unnecessary index sheets to the outside of the image forming apparatus while performing printing, the work of adjusting a bundle of index sheets depending on the product is reduced.

In performing the above-described operation of discharging the unnecessary sheets, in order to prevent the sheets that are discharged as unnecessary sheets and the sheets associated with the print job from being mixed up, the sheets are typically output to different discharge destinations respectively. However, in some cases, the operation of switching the discharge destinations takes time. For example, it is assumed that a printing apparatus has one discharge path, and a post-processing device connected to the discharge path has two discharge trays. The discharge tray that a discharged sheet, which has passed through the discharge path, is stacked on can be controlled by controlling positions of the discharge trays. However, if the discharge destinations are switched by controlling the positions of the discharge trays, it takes time to control the tray positions. As a result, the operation of switching the discharge destinations requires a long processing time. Further, in printing a plurality of copies of the print job, the discharge destination switching operation is performed in each print copy, and the total productivity is largely deteriorated.

SUMMARY OF THE INVENTION

The present invention is directed to reducing processing time for a discharge destination switching operation.

According to an aspect of the present invention, a printing apparatus includes a first acquisition unit configured to acquire a first parameter indicating the number of middle sheets included in one set of carbonless copy paper set in a sheet feed tray, a second acquisition unit configured to acquire a second parameter indicating the number of middle sheets included in one target product, and a control unit configured to, if the second parameter is greater than the first parameter, print on a top sheet and a middle sheet needed necessary for printing a print job, discharge a bottom sheet and a top sheet and a middle sheet included in a next set not needed for printing the print job to a discharge destination different from a discharge destination of the target product, and to print on a middle sheet and a bottom sheet needed for printing the print job.

According to the present invention, processing time of discharge destination switching operation can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
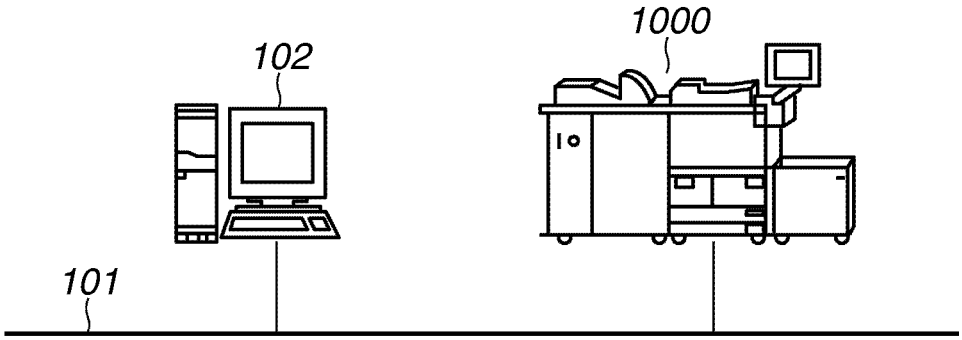
FIG. 1 illustrates an example of a system configuration of a system according to an exemplary embodiment.

FIG. 1 illustrates an example of a configuration of a system according to an exemplary embodiment of the present invention. As illustrated in FIG. 1, the system according to the present exemplary embodiment includes a printing system 1000, a client computer (hereinafter, referred to as PC) 102. The printing system 1000 and the PC 102 are connected with each other via a network 101. The PC 102 transmits page description language (PDL) code data to the printing system 1000 via the network 101.

Figure 2:
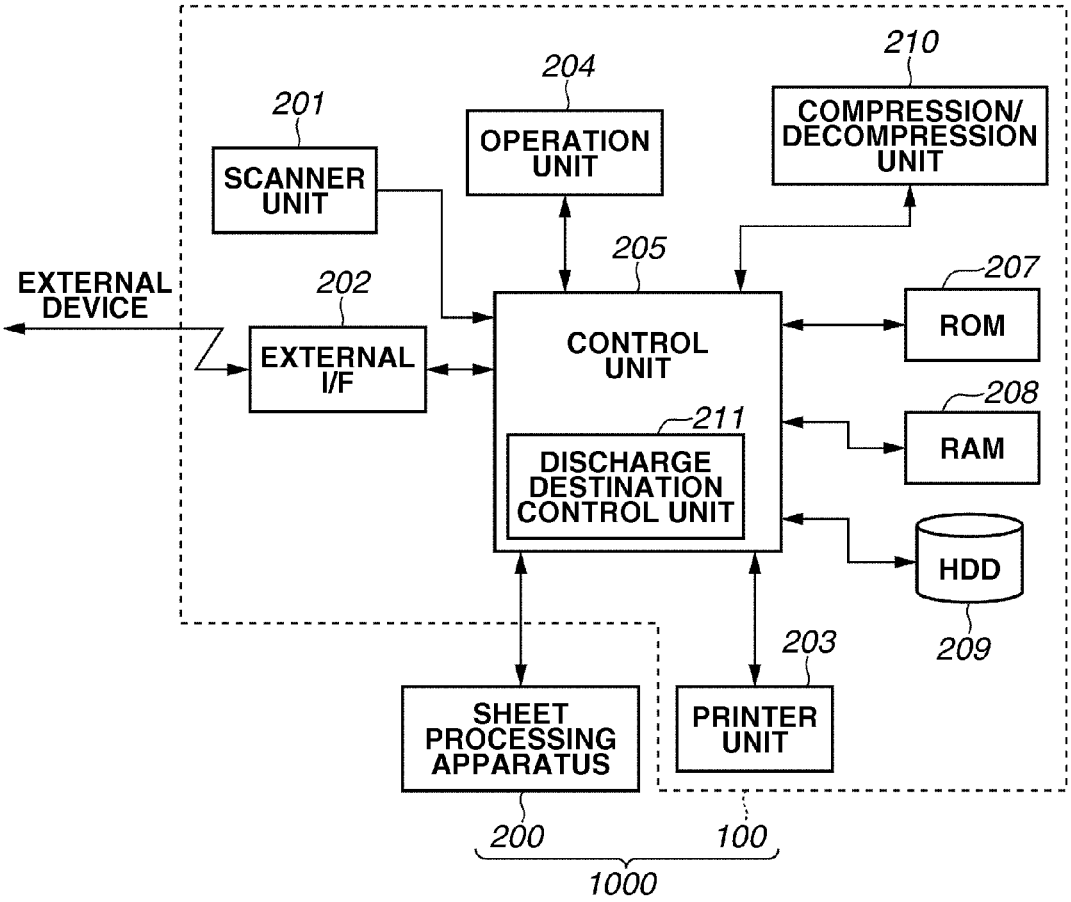
FIG. 2 illustrates an example of a hardware configuration of a printing system.

FIG. 2 illustrates an example of a hardware configuration of the printing system 1000.

The printing system 1000 includes a printing apparatus 100 and a sheet processing apparatus 200. Any number of sheet processing apparatuses 200 can be connected to the printing apparatus 100. In the present exemplary embodiment, as an example of the printing apparatus 100, a multifunction peripheral (MFP) having a plurality of functions such as a copying function and a printing function is described. However, the printing apparatus 100 can be a single function type printing apparatus having only the copying function or the printing function. In the present exemplary embodiment, as one example, the printing system 1000 includes various components described below.

The printing system 1000 is configured to capable of performing sheet processing to a sheet printed in the printing apparatus 100 by the sheet processing apparatus 200 that is connected to the printing apparatus 100. The printing system 1000 can include only the printing apparatus 100 without connecting the sheet processing apparatus 200 to the system 1000. The sheet processing apparatus 200 can communicate with the printing apparatus 100 and perform sheet processing described below in response to an instruction from the printing apparatus 100.

A scanner unit 201 reads an image on a document, converts the image into image data, and transfers the image data to another unit. An external interface (I/F) 202 transmits or receive data to or from another apparatus connected to the network 101. A printer unit 203 prints an image based on the input image data on a sheet.

Figure 3:
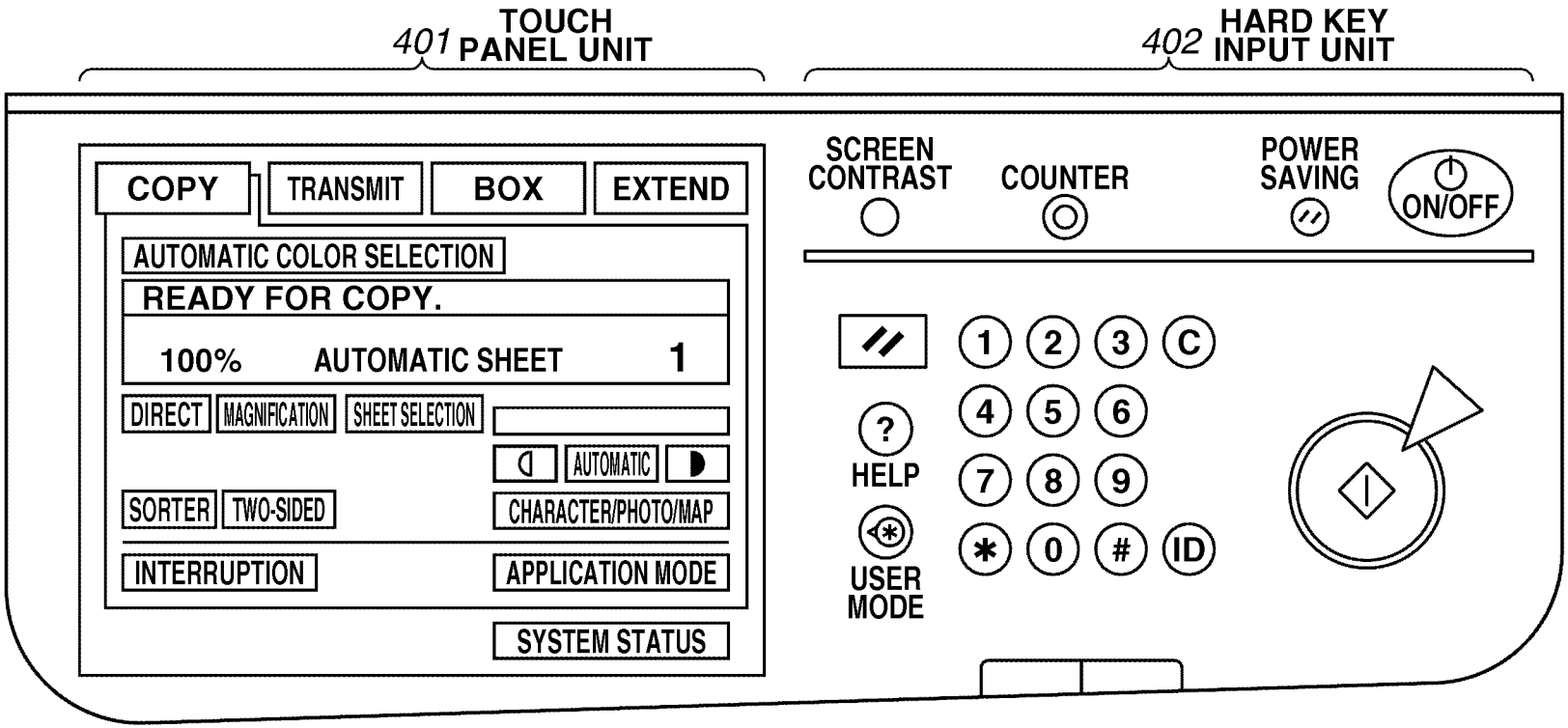
FIG. 3 illustrates an example of an operation unit.

An operation unit 204 has a configuration illustrated in FIG. 3. The operation unit 204 includes a hard key input unit (key input unit) 402 and a touch panel unit 401. Through the units, the operation unit 204 can receive an instruction from an operator. The operation unit 204 performs various types of display on the touch panel unit 401 of the operation unit 204. FIG. 3 is illustrates an example of the operation unit.

A control unit 205 performs overall control of processing or operations of various units included in the printing system 1000. More specifically, the control unit 205 controls operations of the printing apparatus 100 and the sheet processing apparatus 200 connected to the printing apparatus 100. The control unit 205 includes a discharge destination control unit 211 therein, and also performs control of determining to which discharge destination a sheet is to be discharged among a plurality of sheet discharge destinations in the sheet processing apparatus 200.

A read-only memory (ROM) 207 stores various computer programs executed by the control unit 205. For example, the ROM 207 stores a program for causing the control unit 205 to perform various processing in a flowchart described below or a display control program necessary to display various setting screens described below. The ROM 207 also stores a program for causing the control unit 205 to interpret PDL code data received from the PC 102 and to rasterize the data into raster image data. The ROM 207 also stores a boot sequence and font information.

A random access memory (RAM) 208 stores image data or PDL record data transmitted from the scanner unit 201 or the external I/F 202 and various programs and setting information loaded from the ROM 207. The RAM 208 also stores information about the sheet processing apparatus 200, for example, information about the type and functions of each sheet processing apparatus 200 connected to the printing apparatus 100. The control unit 205 can use the information about the sheet processing apparatus 200 stored in the RAM 208 for control.

A hard disk drive (HDD) 209 includes a hard disk and a drive unit for reading and writing data from and to the hard disk. The HDD 209 is a large capacity storage device for storing image data input from the scanner unit 201 and compressed by a compression/decompression unit 210. The control unit 205 can print the image data stored in the HDD 209 by the printer unit 203 according to an instruction from an operator. The HDD 209 is also used as a spooler. The control unit 205 can manage PDL record data received from the PC 102 as a job, and store the job in the HDD 209. The control unit 205 also can manage the job stored in the HDD 209, and acquire the number of jobs and setting information set to the jobs.

The compression/decompression unit 210 compresses and decompresses image data or the like stored in the RAM 208 and the HDD 209 using various compression formats such as Joint Bi-level Image Experts Group (JBIG) or Joint Photographic Experts Group (JPEG).

Figure 4:
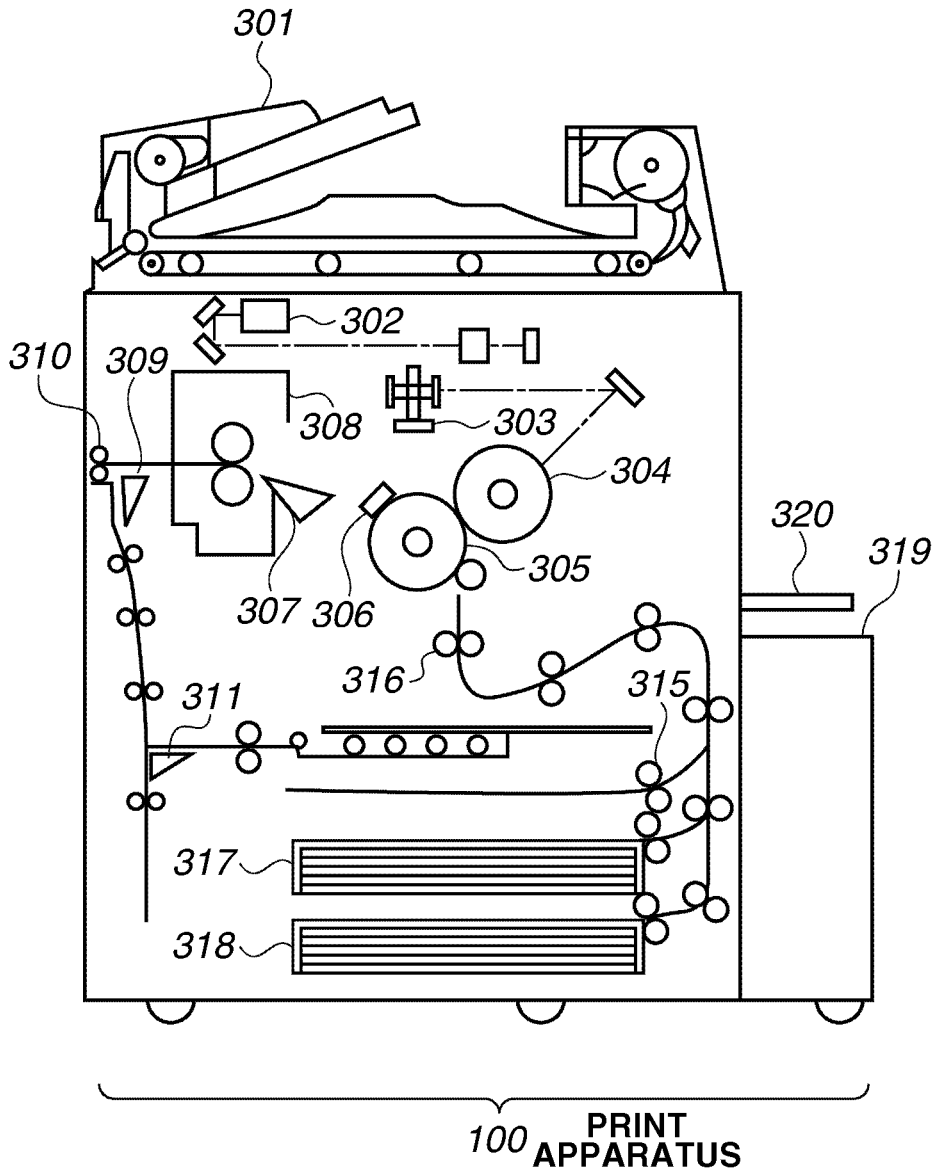
FIG. 4 is a cross sectional view illustrating a printing apparatus.

Next, the configuration of the printing system 1000 is described. FIG. 4 is a cross sectional view illustrating the printing apparatus 100. The control unit 205 receives an execution request of sheet processing specified by a user from among candidates of sheet processing of types executable in the sheet processing apparatus 200 connected to the printing apparatus 100 via the operation unit 204 together with a print execution request. Depending of the request, the control unit 205 instructs the printer unit 203 to perform the print processing necessary for the job. The control unit 205 performs control to convey a sheet of the job on which the printing is performed to the sheet processing apparatus that can perform the sheet processing specified by the user via the sheet conveyance path. Then, the control unit 205 instructs the sheet processing apparatus to perform the sheet processing.

In the present exemplary embodiment, an example of a finisher 501 that serves as the sheet processing apparatus 200 connected to the printing apparatus 100 is described. The finisher 501 has two discharge destinations (trays capable of stacking sheets) and the stapling function and the punching function. The finisher is described below with reference to FIG. 5.

In FIG. 4, an automatic document feeder (ADF) 301 separates a bundle of documents set on a stacking surface of a document tray in order of pages from the first page and conveys the document on a document positioning glass plate for a scanner 302 to scan the document. The scanner 302 reads an image of the document conveyed on the document positioning glass plate, and converts the read image into image data using a charge coupled device (CCD). Light, for example, laser light modulated according to the image data is incident on a rotating polygonal mirror (polygon mirror, or the like) 303, and illuminates a photosensitive drum 304 as reflected scanning light via a reflection mirror. A latent image formed on the photosensitive drum 304 by the laser light is developed by toner. The toner image is transferred to a sheet material attached on a transfer drum 305.

A series of image formation processes is sequentially performed to toner of yellow (Y), magenta (M), cyan (C), and black (B), and as a result, a full-color image is formed. The sheet material, on which the full-color image is formed after the four times of image formation processes, is separated from the transfer drum 305 by a separation claw 306, and conveyed to a fixing device 308 by a pre-fixing carrier 307. The fixing device 308 includes a combination of rollers and a belt, and further includes a heat source such as a halogen heater. The fixing device 308 melts and fixes the toner on the sheet material on which the toner image is transferred by heat and pressure.

A discharge flapper 309 is arranged pivotally about a pivot and regulates the conveyance direction of the sheet material. When the discharge flapper 309 swings in the clockwise direction in the drawing, the sheet material is conveyed straight, and further conveyed from the printing apparatus by discharge rollers 310 to the sheet processing apparatus 200 that is connected to the latter part. The control unit 205 controls the printing apparatus 100 to perform printing according to the above-described a series of sequences.

The printing apparatus 100 further includes a sheet feeding unit for storing sheets necessary for printing. The sheet feeding unit may include sheet feed cassettes 317 and 318 (for example, each cassette can store 500 sheets), a sheet feed deck 319 (for example, the sheet feed deck can store 5000 sheets), a manual feed tray 320, and the like. To the sheet feed cassettes 317 and 318 and the sheet feed deck 319, various sheets of different sizes and different materials can be separately set respectively. To the manual feed tray 320, various sheets including special sheets such as an overhead projector (OHP) sheet can be set. To each of the sheet feed cassettes 317 and 318, the sheet feed deck 319, and the manual feed tray 320, feeding rollers are provided. The feeding rollers can sequentially feed the sheets one by one.

Figure 5:
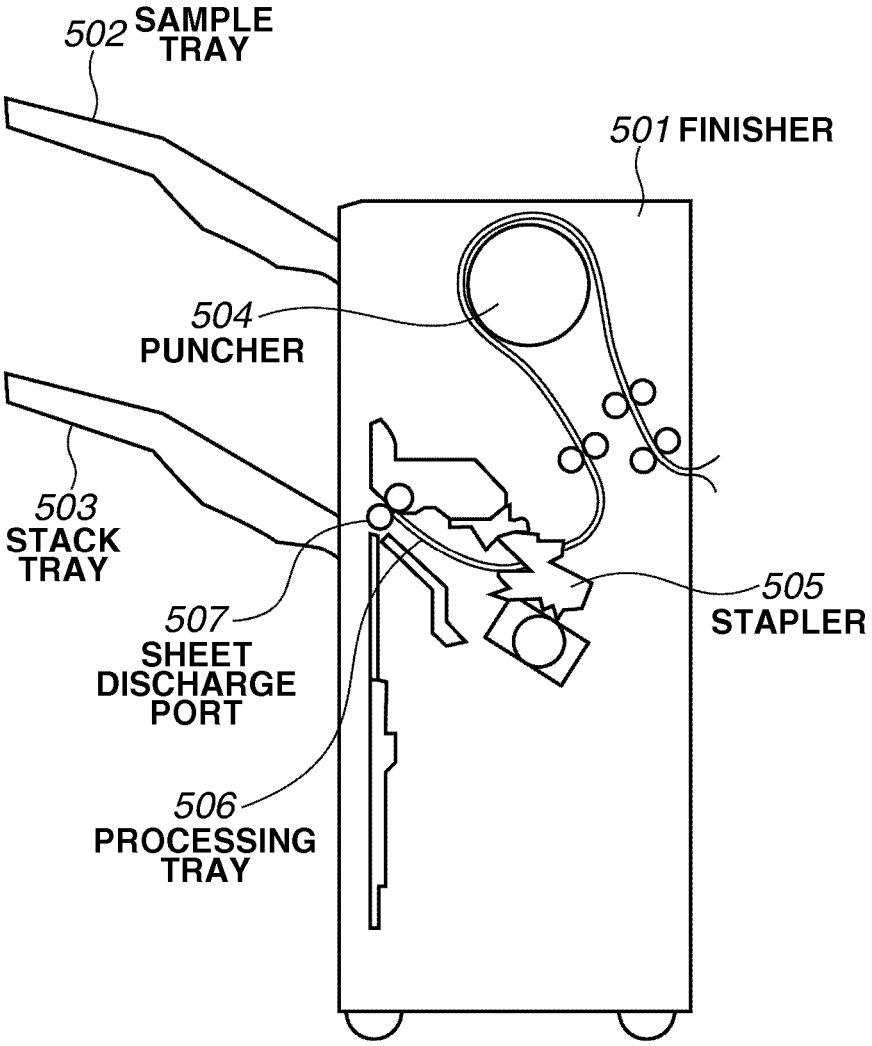
FIG. 5 is a cross sectional view illustrating a finisher.

The finisher 501 is described with reference to the cross-sectional view in FIG. 5. The finisher 501 includes a puncher 504 and a stapler 505. The finisher 501 can selectively perform punching processing or stapling processing to a sheet conveyed from the printing apparatus 100. The finisher 501 further includes a sample tray 502 and a stack tray 503 on the outside of the device.

If the control unit 205 receives an instruction to perform the stapling processing in the finisher, the control unit 205 performs control to sequentially stack sheets printed in the printing apparatus 100 and conveyed on a processing tray 506 in the finisher. If a bundle of sheets is stacked on the processing tray 506, the control unit 205 instructs the stapler 505 to perform stapling processing. Then, the control unit 205 performs control to discharge a bundle of the stapled sheets from the processing tray 506 to a discharge tray, that is the stack tray 503 or the sample tray 502, via a sheet discharge port 507.

If the control unit 205 receives an instruction to perform the punching processing in the finisher, the control unit 205 instructs the puncher 504 to perform the punching processing on the sheets printed in the printing apparatus 100 and conveyed. Then, the control unit 205 performs control to convey the sheets through the inside of the finisher and discharge the sheets to the discharge tray, that is the stack tray 503 or the sample tray 502, via the sheet discharge port 507.

To which stack tray of the stack tray 503 or the sample tray 502 the sheets are discharged is controlled by the discharge destination determination unit 211 provided in the control unit 205. According to the determination, the discharge destination control unit 211 performs control the discharge tray of the discharge target to be placed to the position of the sheet discharge port 507. For example, if the discharge destination is changed to the sample tray 502 from the state illustrated in FIG. 5, the discharge destination control unit 211 performs control such that the both trays are moved downward, and the sample tray 502 is placed to the position of the sheet discharge port 507. While the discharge tray position is changed as described above, the sheet discharge operation is stopped, and the print processing is also stopped. Thus, it is preferable to quickly perform the position changing processing of the discharge trays. However, actually, it takes some time. In order to maintain the productivity of the printing, it is important to reduce the sheet discharge destination switching control as much as possible.

Figure 6:
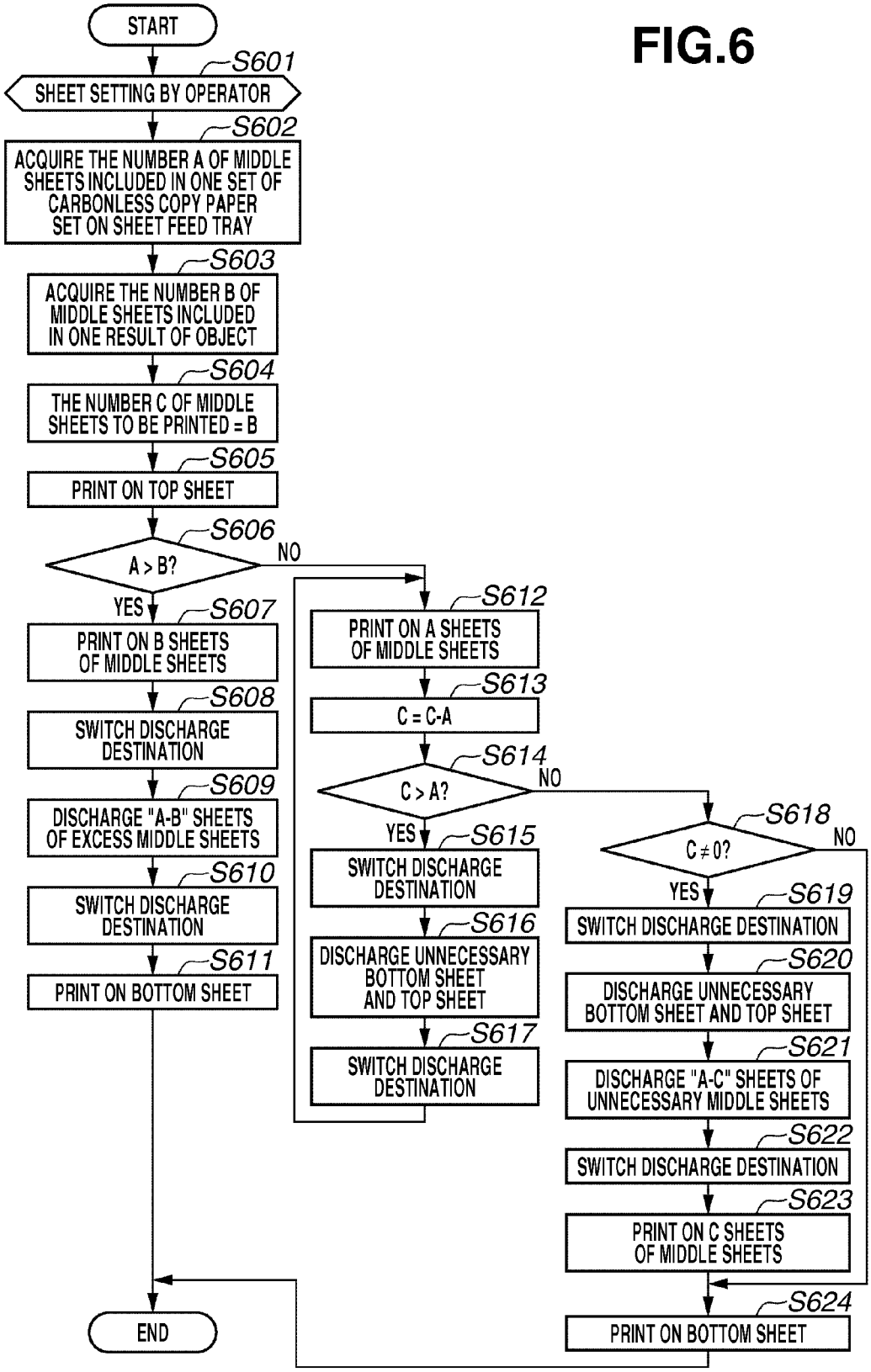
FIG. 6 is a flowchart illustrating an example of processing in print control.

Next, processing according to the present exemplary embodiment is described with reference to FIG. 6. FIG. 6 is a flowchart illustrating an example of the processing in the print control.

Figure 7A:
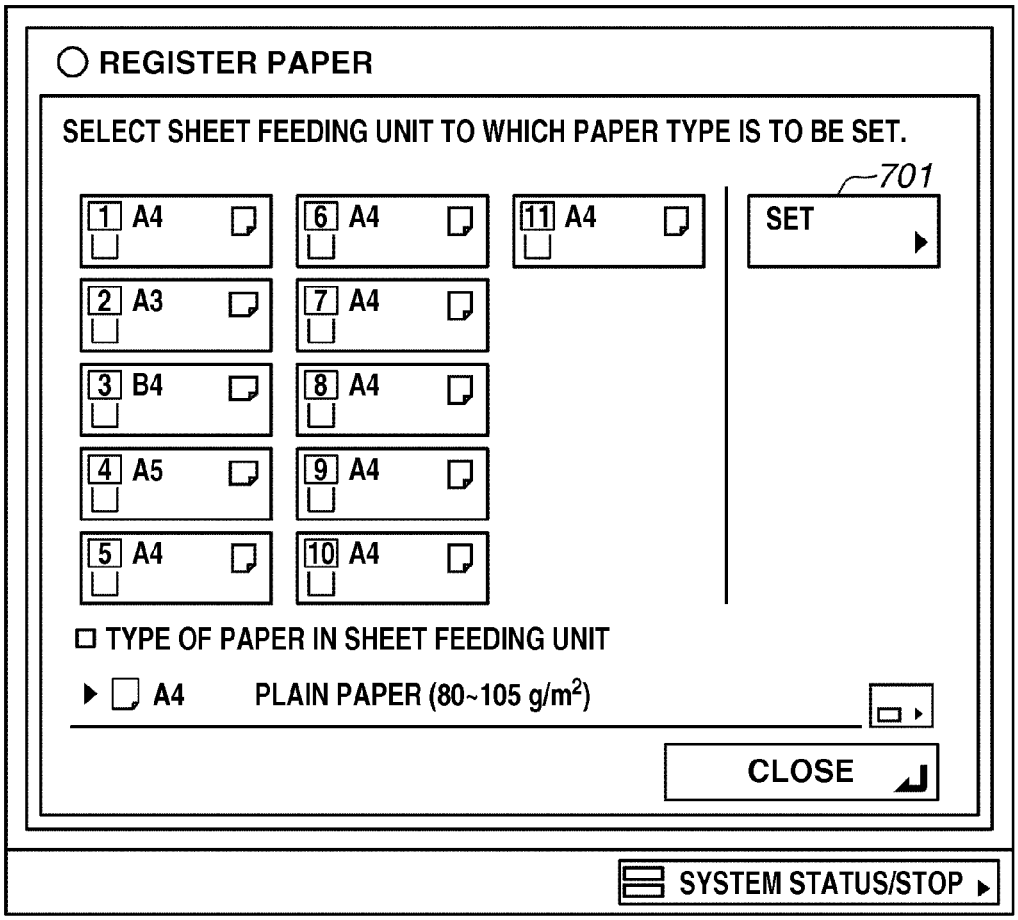
FIGS. 7A to 7C illustrate examples of sheet setting screens.
Figure 7B:
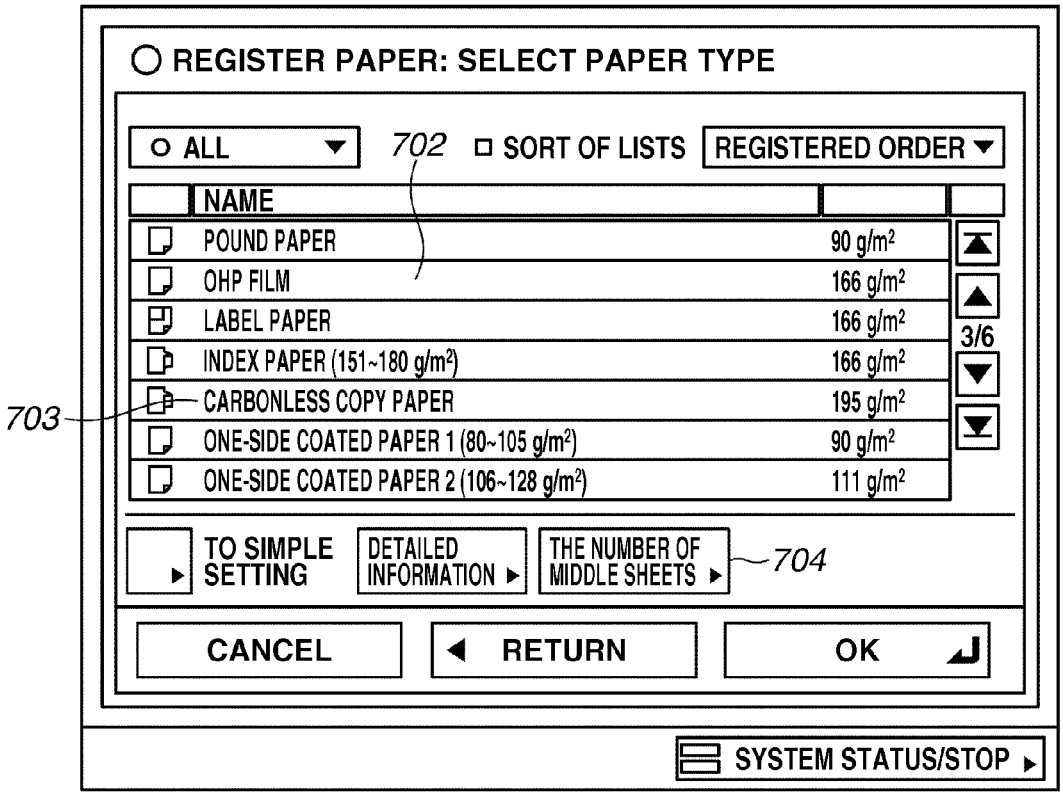
Figure 7C:
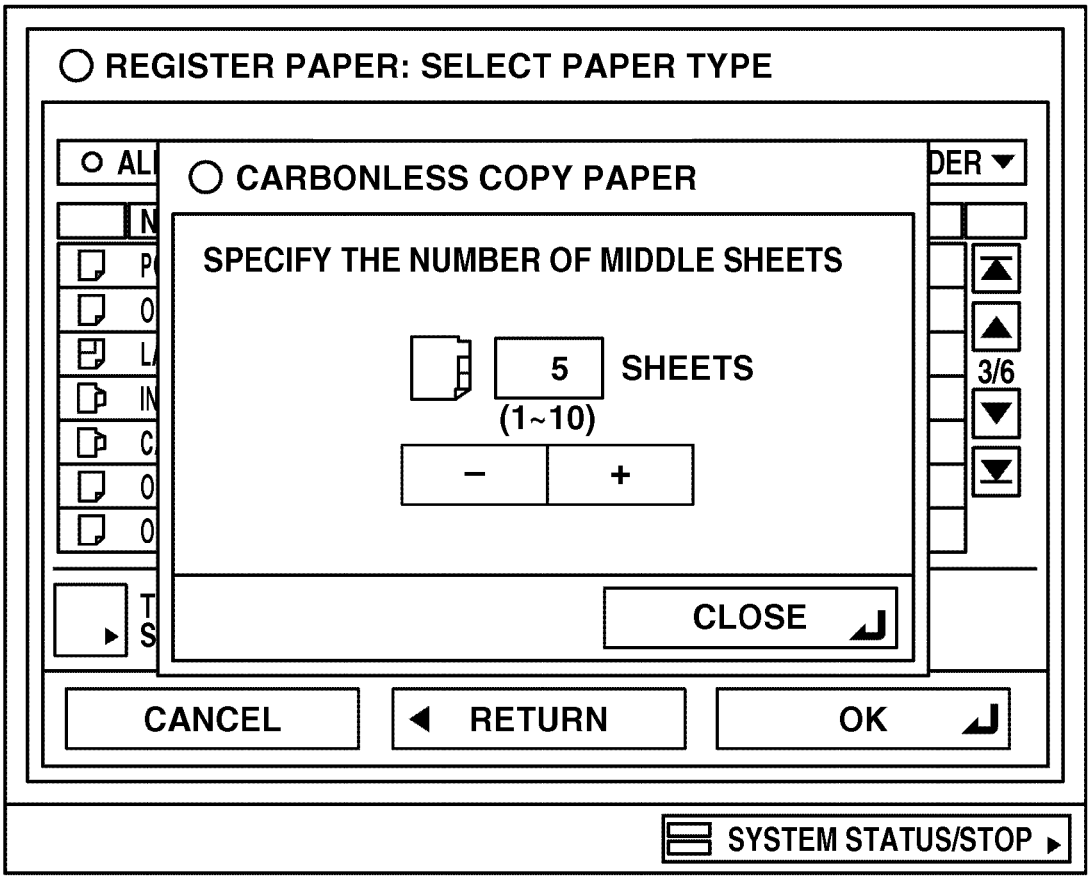

First, in step S601, the control unit 205 displays sheet setting screens as illustrated in FIGS. 7A to 7C on the touch panel unit 401 to prompt an operator to set a setting of the type of paper, i.e. carbonless copy paper, and the number A of middle sheets included in one set of the carbonless copy paper to be used.

More specifically, the control unit 205 displays the screen illustrated in FIG. 7A, and prompts the operator to select the sheet feeding unit to which the type of paper is set. In response to the operator's selection of the sheet feeding unit and pressing a setting button 701, the control unit 205 displays the screen in FIG. 7B, and prompts the operator to select the type of paper. On a list display part 702 in FIG. 7B, a list of the types of paper registered in the printing apparatus is displayed. The operator can select a desired type of paper from the list.

If the operator selects an entry 703 of the carbonless copy paper, the control unit 205 displays a setting button 704 for setting the number of middle sheets on a lower part of the list display part 702. When the operator presses the setting button 704 for setting the number of the middle sheets, the control unit 205 displays the screen in FIG. 7C, and prompts the operator to the number A of the middle sheets included in one set of the carbonless copy paper to be used.

In step S602, the control unit 205 acquires the number A of the middle sheets ("A" acquisition) set by the operator in step S601. In other words, the control unit 205 acquires the number A of the middle sheets included in one set of the carbonless copy paper set in the sheet feed tray. More specifically, the control unit 205 acquires the number A of the middle sheets based on a user's setting operation on the sheet setting screen described below. The acquired value is stored in the RAM 208 by the control unit 205. In subsequent control, the value is called and used as needed.

In step S603, the control unit 205 receives a job, and analyzes the job to acquire the number B of the middle sheets ("B" acquisition) included in a target product. Similar to the above, the acquired value is stored in the RAM 208 by the control unit 205, and referred to as needed.

In step S604, the control unit 205 initializes a counter C for calculating the number of the middle sheets necessary to produce one product using the value B. The counter C is counted down each time one middle sheet is printed. A value of the counter C is stored in the RAM 208 similar to the above. In step S605, the control unit 205 performs printing on a top sheet. In the present exemplary embodiment, the control is performed so that the product is discharged to the stack tray 503. Accordingly, the control unit 205 performs control to discharge unnecessary paper on the sample tray 502.

In step S606, the control unit 205 compares the number A of the middle sheets included in one set of the carbonless copy paper to be used with the number B of the middle sheet included in one target product.

In step S606, if the control unit 205 determines that the number A is larger than the number B (YES in step S606), then in step S607, the control unit 205 performs control to print B sheets of the middle sheets and discharge the printed sheets to the stack tray 503. In the state, normally the control unit 205 tries to print on the bottom sheet. However, since the number A is larger than the number B, "A−B" sheets of the middle sheets still remain in the sheet feeding unit.

In order to discharge the remaining middle sheets, in step S608, the control unit 205 performs control to switch the discharge destination to the sample tray 502. In step S609, the control unit 205 discharges the "A−B" sheets of the excess middle sheets remaining in the sheet feed tray to the sample tray 502. Then in step S610, the control unit 205 performs control to switch the discharge destination to the stack tray again. In step S611, the control unit 205 finally prints on the bottom sheet. By the processing, one product is produced. If a plurality of products is produced, the processing after the processing in step S605 is repeated a necessary number of times.

In step S606, if the control unit 205 determines that the number A is smaller than or equal to the number B (NO in step S606), then in step S612, the control unit 205 performs control to print on A sheets of the middle sheets and discharge the printed sheets to the stack tray 503. In step S613, the control unit 205 subtracts the number A of the printed middle sheets from the value of the counter C (value C). In step S614, the control unit 205 compares the value C subtracted in step S613 with the value A.

In step S614, if the control unit 205 determines that the value C is larger than the value A (YES in step S614), it is further necessary to print the middle sheets of the number larger than the number of the middle sheets included in one set of the carbonless copy paper set in the sheet feeding unit. Therefore, the control unit 205 normally tries to perform control to feed the middle sheet from the sheet feeding unit and print thereon. However, in the sheet feeding unit, the bottom sheet and the top sheet of the next set still remain.

In order to discharge the remaining sheets, in step S615, the control unit 205 performs control to switch the discharge destination to the sample tray 502. In step S616, the control unit 205 discharges the bottom and top sheet remaining in the sheet feeding unit to the sample tray 502. In step S617, the control unit 205 performs control to switch the discharge destination to the stack tray 503 again. Then, the control unit 205 repeats the processing after step S612.

If the control unit 205 determines that the value A is larger than the value C in step S614 (NO in step S614), then in step S618, the control unit 205 determines whether the value C is zero. If the value C is zero (NO in step S618), the control unit 205 determines that the printing on the necessary number of the middle sheets is completed. In step S624, the control unit 205 performs control to print on the bottom sheet.

In step S618, if the control unit 205 determines that the value C is not zero (YES in step S618), although the value is smaller than the value A, it is necessary to perform the printing on the middle sheet. Therefore, the control unit 205 normally tries to perform control to feed the middle sheet from the sheet feeding unit and print thereon. However, in the sheet feeding unit, the bottom sheet and the top sheet of the next set still remain. Then, similar to the above-described processing, in order to discharge the remaining sheets, in step S619, the control unit 205 performs control to switch the discharge destination to the sample tray 502.

In step S620, the control unit 205 performs control to discharge the bottom sheet and the top sheet remaining in the sheet feeding unit to the sample tray 502.

Then, necessary printing is performed on the middle sheet. In the processing, as is described in steps S607 to S611, after the middle sheet is printed, it is necessary to discharge "A−C" sheets of the middle sheets as excess sheets to the sample tray 502. Accordingly, before the printing on the middle sheet, in step S621, the control unit 205 performs control to discharge "A−C" sheets of the unnecessary middle sheets to the sample tray 502.

In step S622, the control unit 205 switches the discharge destination to the stack tray 503 again. Then in step S623, the control unit 205 prints C sheets of the necessary middle sheets. In step S624, the control unit 205 finally prints on the bottom sheet.

Figure 8:
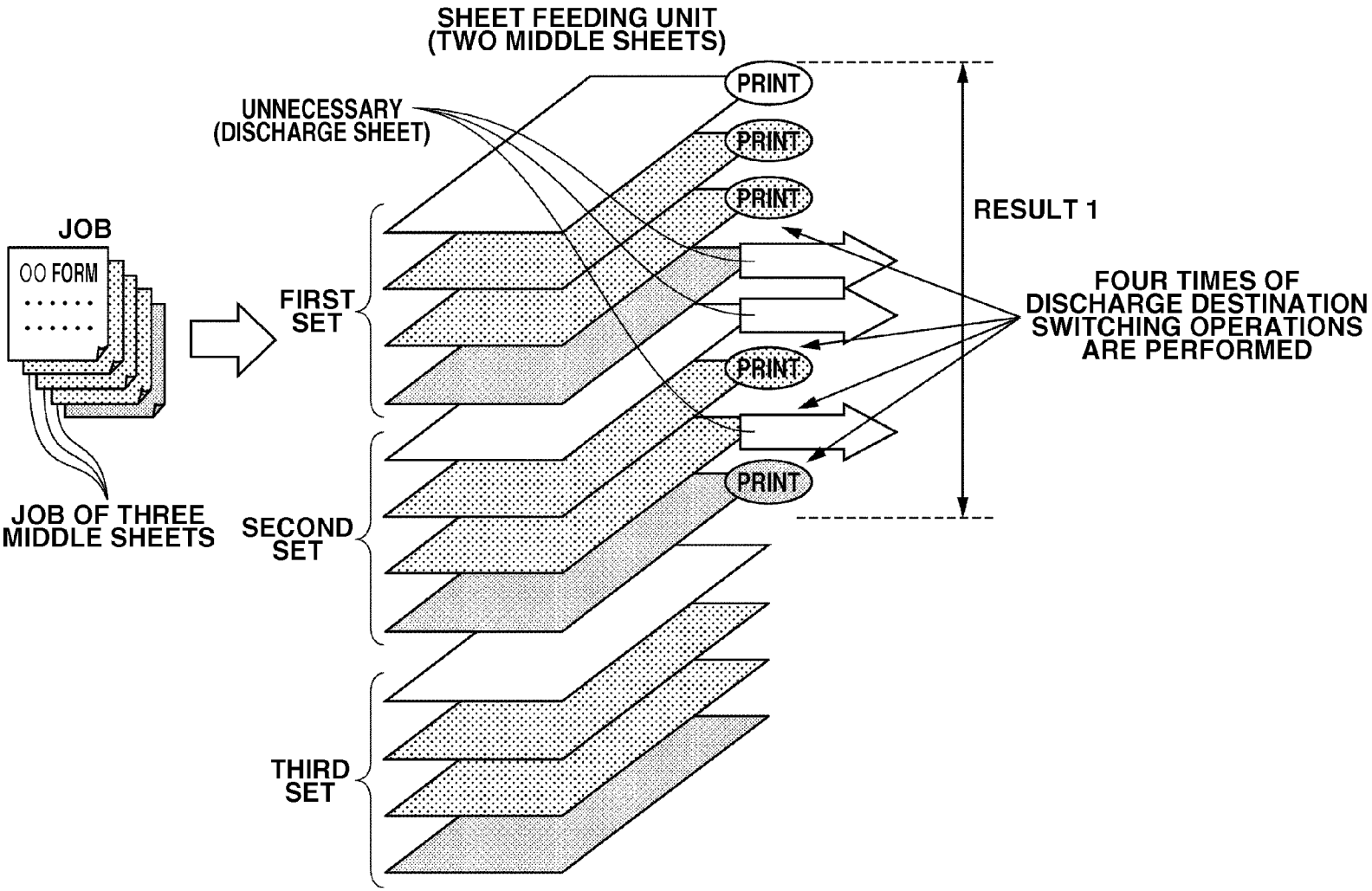
FIG. 8 illustrates an example of sheet discharge control in printing on carbonless copy paper using a conventional technique.
Figure 9:
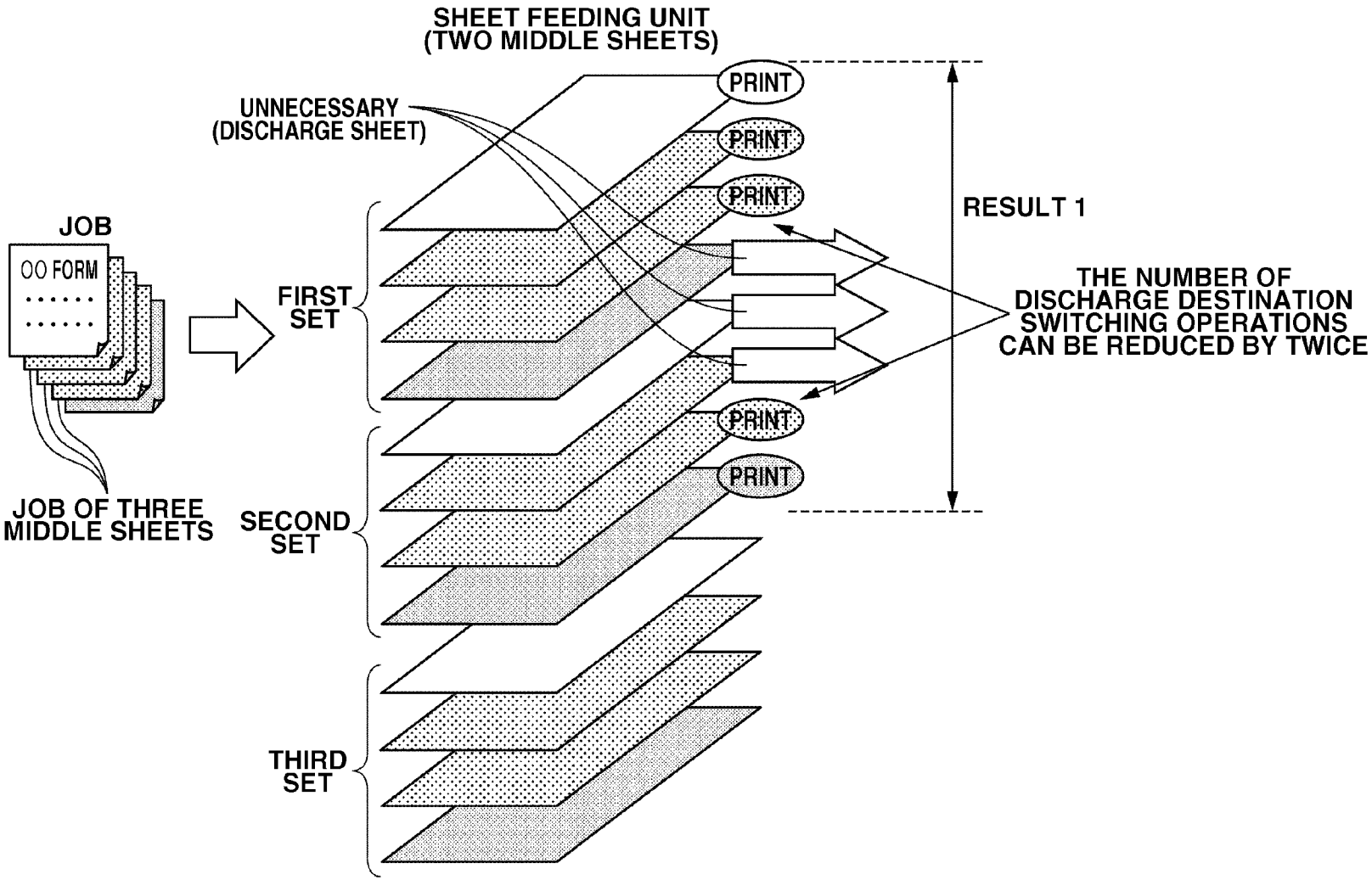
FIG. 9 illustrates an example of sheet discharge control in printing on carbonless copy paper using a technique according to the exemplary embodiment.

Next, processing according to the present exemplary embodiment is described with reference to FIGS. 8 and 9. FIG. 8 illustrates an example of sheet discharge control in printing on carbonless copy paper using a conventional technique. FIG. 9 illustrates an example of sheet discharge control in printing on carbonless copy paper using the technique according to the present exemplary embodiment.

In both of FIGS. 8 and 9, the number A of the middle sheets included in one set of the carbonless copy paper is two, and the number B of the middle sheets used in a product is three. In the case where the number A is two and the number B is three, as illustrated in FIG. 8, if the carbonless copy paper is printed using the conventional technique, the discharge destination will be switched four times. On the other hand, as illustrated in FIG. 9, if the carbonless copy paper is printed using the technique according to the present exemplary embodiment, the discharge destination will be switched twice. Accordingly, the number of the discharge destination switching operations can be reduced by twice.

The processing illustrated in FIG. 9 is described in more detail. As in the case where the value A is two and the value B is three, if the value B is larger than the value A, the control unit 205 performs printing while the sheet unnecessary for the printing is discharged to the discharge destination different from that for the product. In the processing, as illustrated in FIG. 9, the control unit 205 performs the control as follows:

(1) print on "B−(a remainder obtained by dividing B by A)" sheets of the middle sheets, (2) subsequent to the unnecessary bottom sheet and the top sheet, discharge "A−(a remainder obtained by dividing B by A)" sheets of the middle sheets to the discharge destination different from that of the product, and then perform control to print on the middle sheet and the bottom sheet necessary for printing.

As described above, the control unit 205 performs control to discharge the unnecessary middle sheets first, and then sequentially output the middle sheet and the bottom sheet. By the processing, the number of the discharge destination switching operations can be reduced. In the case where the value A is two and the value B is three, the control unit 205 performs the control as follows:

(1) print on "3−(a remainder obtained by dividing 3 by 2)"="2" sheets of the middle sheets, (2) subsequent to the unnecessary bottom sheet and the top sheet, discharge "2−(a remainder obtained by dividing 3 by 2)"="1" sheet of the middle sheet to the discharge destination different from that of the product, and perform control to print on the middle sheet and the bottom sheet necessary for the printing.

The processing in the above-described (1) corresponds to the processing in steps S612 to S617 in FIG. 6. The processing in the above-described (2) corresponds to the processing in steps S618 to S624 in FIG. 6.

According to the present exemplary embodiment, the processing time for the discharge destination switching operations can be reduced, and an effect of increasing the productivity in the entire printing work can be expected. Especially, the above-described printing system that takes time for switching the discharge destinations can achieve a large effect.

According to the present exemplary embodiment, the number of the discharge destination switching operations can be reduced by twice as a whole. If a job for producing a product that uses five middle sheets, which is one of common types of products that use carbonless copy paper, is provided, the number of the discharge destination switching operations is about six times. According to the present exemplary embodiment, the number of the discharge destination switching operations can be reduced to about four times. Thus, the processing time can be reduced by at least about 30 percent.

As described above, according to the present exemplary embodiment, the processing time for the discharge destination switching operations can be reduced.

Aspects of the present invention can also be realized by a computer of a system or apparatus (or devices such as a central processing unit (CPU) or a micro processing unit (MPU)) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-204358 filed Sep. 13, 2010, which is hereby incorporated by reference herein in its entirety.

What is claimed is:

1. A printing apparatus comprising:

a first acquisition unit configured to acquire a first parameter indicating a number of middle sheets included in one set of carbonless copy paper set in a sheet feed tray;

a second acquisition unit configured to acquire a second parameter indicating a number of middle sheets included in one target product;

a printer unit configured to print a print job; and a control unit configured to control, if the second parameter is greater than the first parameter, the printer unit to print on a top sheet and a middle sheet needed for printing a print job, discharge a bottom sheet and a top sheet and a middle sheet included in a next set that are not needed for printing the print job to a discharge destination different from a discharge destination of the target product, and to control the printer unit to print on a middle sheet and a bottom sheet needed for printing the print job.

2. The printing apparatus according to claim 1, wherein if the second parameter is greater than the first parameter, the control unit controls the printer unit to print on the top sheet needed for printing the print job, and prints on a number of middle sheets equal to a remainder amount obtained by dividing the second parameter by the first parameter, wherein the control unit discharges the bottom sheet and the top sheet not needed for printing the print job and a number of middle sheets equal to a remainder amount obtained by dividing the second parameter by the first parameter subsequent thereto to the discharge destination different from the discharge destination of the target product, and wherein the control unit controls the printer unit to print on the middle sheet and the bottom sheet needed for printing the print job.

3. The printing apparatus according to claim 1, wherein the first acquisition unit acquires the first parameter indicating the number of the middle sheets based on a user's setting operation.

4. The printing apparatus according to claim 1, wherein the second acquisition unit acquires the second parameter indicating the number of the middle sheets included in a print job that is a target product from the print job.

5. A method for print control performed by a printing apparatus, the method comprising:

acquiring a first parameter indicating a number of middle sheets included in one set of carbonless copy paper set in a sheet feed tray;

acquiring a second parameter indicating a number of middle sheets included in one target product;

printing a print job;

controlling, if the acquired second parameter is greater than the acquired first parameter, printing on a top sheet and a middle sheet needed for printing a print job;

discharging a bottom sheet and a top sheet and a middle sheet included in a next set that is not needed for printing the print job to a discharge destination different from a discharge destination of the target product; and controlling printing on a middle sheet and a bottom sheet needed for printing the print job.

6. A non-transitory computer-readable storage medium storing computer-executable process steps, the computer-executable process steps causing a computer to execute a method comprising:

acquiring a first parameter indicating a number of middle sheets included in one set of carbonless copy paper set in a sheet feed tray;

acquiring a second parameter indicating a number of middle sheets included in one target product;

printing a print job;

controlling, if the acquired second parameter is greater than the acquired first parameter, printing on a top sheet and a middle sheet needed for printing a print job;

discharging a bottom sheet and a top sheet and a middle sheet included in a next set not needed for printing the print job to a discharge destination different from a discharge destination of the target product; and controlling printing on a middle sheet and a bottom sheet needed for printing the print job.

* * * * *